US009307604B2

(12) United States Patent
Sun et al.

(10) Patent No.: US 9,307,604 B2
(45) Date of Patent: Apr. 5, 2016

(54) DIMMABLE LED LAMP AND DIMMING METHOD

(71) Applicant: SENGLED OPTOELECTRONICS CO., LTD, Tongxiang (CN)

(72) Inventors: Chaoqun Sun, Tongxiang (CN); Xia Wang, Tongxiang (CN); Jinxiang Shen, Tongxiang (CN)

(73) Assignee: SENGLED OPTOELECTRONICS CO., LTD, Tongxiang (CN)

( * ) Notice: Subject to any disclaimer, the term of this patent is extended or adjusted under 35 U.S.C. 154(b) by 0 days.

(21) Appl. No.: 14/626,424

(22) Filed: Feb. 19, 2015

(65) Prior Publication Data

US 2015/0163880 A1 Jun. 11, 2015

Related U.S. Application Data

(63) Continuation-in-part of application No. PCT/CN2014/088804, filed on Oct. 17, 2014.

(30) Foreign Application Priority Data

Nov. 15, 2013 (CN) ..... 2013 1 0571759

(51) Int. Cl.
*H05B 33/08* (2006.01)
*H05B 37/02* (2006.01)

(52) U.S. Cl.
CPC ..... *H05B 33/0851* (2013.01)

(58) Field of Classification Search
CPC ..... H05B 33/0845; H05B 37/0209
USPC ..... 315/250, 210, 224, 294, 291
See application file for complete search history.

(56) References Cited

U.S. PATENT DOCUMENTS

2011/0121754 A1* 5/2011 Shteynberg ..... H05B 33/0815 315/294
2013/0334980 A1* 12/2013 Zhou ..... H05B 33/0845 315/250
2014/0191671 A1* 7/2014 Huang ..... H05B 33/0815 315/186

FOREIGN PATENT DOCUMENTS

CN 102098854 A 6/2011
CN 202183900 U 4/2012
CN 102869156 A 1/2013
CN 103068123 A 4/2013
CN 103607818 A 2/2014
CN 203590555 U 5/2014

OTHER PUBLICATIONS

The World Intellectual Property Organization (WIPO) International Search Report for PCT/CN2014/088804 Jan. 28, 2015.

* cited by examiner

*Primary Examiner* — Daniel D Chang
(74) *Attorney, Agent, or Firm* — Anova Law Group, PLLC

(57) ABSTRACT

A dimmable light emitting diode (LED) lamp is provided. The dimmable LED lamp includes an alternating current (AC) input unit and at least one AC detection unit connected to the AC input unit. The dimmable LED lamp also includes at least one LED driving and power supply unit and at least one LED light source assembly, where the LED driving and power supply unit is connected to the LED light source assembly. Further, the dimmable LED lamp includes at least one controller with a pulse width modulation (PWM) output, wherein the AC detection unit is connected to the controller, and the controller is connected to the LED driving and power supply unit.

16 Claims, 2 Drawing Sheets

DIMMABLE LED LAMP AND DIMMING METHOD

CROSS-REFERENCES TO RELATED APPLICATIONS

This application is a continuation-in-part (CIP) of PCT Patent Application No. PCT/CN2014/088804, filed on Oct. 17, 2014, which claims priority to Chinese Patent Application No. 201310571759.0, filed on Nov. 15, 2013, the entire contents of all of which are incorporated herein by reference.

FIELD OF THE INVENTION

The present disclosure generally relates to the field of light emitting diode (LED) lighting technology and, more particularly, relates to a dimmable LED lamp and a method for dimming an LED lamp.

BACKGROUND

LED lighting may generally provide advantages in energy conservation, environmental protection, adjustable lighting, solid state lighting, and long operational lifetime. LED lamps thus have been widely used in various areas for public, commercial, and/or indoor lighting.

Often, LED lamps with a dimming function may not only save energy, but also provide various experiences for people in different places. Currently, the LED lamps on the market may provide uniform brightness without the dimming function. Alternatively, a professional dimmer is needed to implement the dimming function of the LED lamps. However, to add a dimmer in the LED lamps may increase the cost in use and can require complicated, additional installation. Such designs have poor compatibility and low efficiency.

The disclosed dimmable LED lamps and dimming methods are directed to solve one or more problems set forth above and other problems.

BRIEF SUMMARY OF THE DISCLOSURE

One aspect of the present disclosure includes a dimmable light emitting diode (LED) lamp. The dimmable LED lamp includes an alternating current (AC) input unit and at least one AC detection unit connected to the AC input unit. The dimmable LED lamp also includes at least one LED driving and power supply unit and at least one LED light source assembly, where the LED driving and power supply unit is connected to the LED light source assembly. Further, the dimmable LED lamp includes at least one controller with a pulse width modulation (PWM) output function, where the AC detection unit is connected to the controller, and the controller is connected to the LED driving and power supply unit.

Another aspect of the present disclosure includes a method for dimming a dimmable LED lamp. The method includes turning on a switch of the dimmable LED lamp and detecting status of an AC input, where the status of the AC input includes power-on status and power-off status. The method also includes adjusting automatically brightness within a given time period and detecting whether the switch is turned off within the given time period. Further, the method includes when the switch is not turned off, maintaining the brightness at the level when a dimming process is completed and when the switch is turned off, recording the brightness level at the time when the dimmable LED lamp is turned off. In addition, the method includes turning on the switch again and maintaining the brightness at the level when the dimmable LED lamp is turned off last time.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

Figure 1:
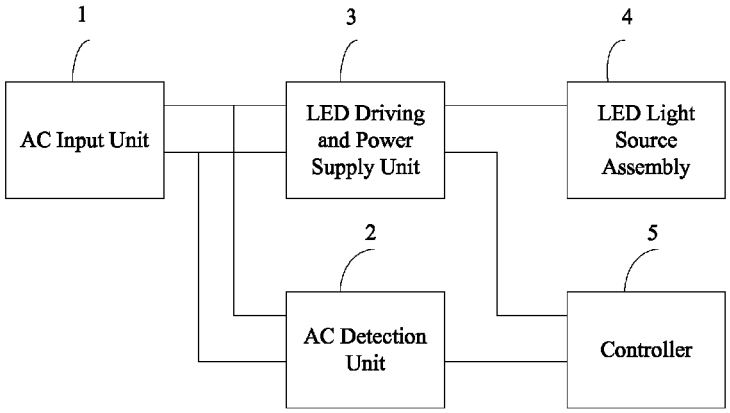
FIG. 1 illustrates a block diagram of an exemplary dimmable LED lamp consistent with the disclosed embodiments.
Figure 2:
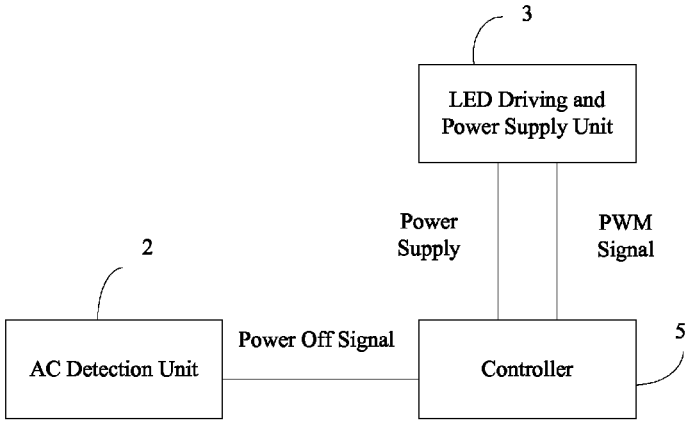
FIG. 2 illustrates a schematic diagram of an exemplary circuit of a dimmable LED lamp consistent with the disclosed embodiments.

FIG. 1 illustrates a block diagram of an exemplary dimmable LED lamp consistent with the disclosed embodiments. FIG. 2 illustrates a schematic diagram of an exemplary circuit of a dimmable LED lamp consistent with the disclosed embodiments. As shown in FIG. 1 and FIG. 2, the dimmable LED lamp may include an alternating current (AC) input unit 1, at least one AC detection unit 2, at least one LED driving and power supply unit 3, at least one LED light source assembly 4, and at least one controller 5 with a pulse width modulation (PWM) output function. The PWM is a modulation technique that controls the width of the pulse, formally the pulse duration, based on modulator signal information. The AC input unit 1 is connected to the AC detection unit 2. The AC detection unit 2 is configured to convert a signal of the AC input unit 1 to signal level. The AC detection unit 2 is connected to the controller 5. The controller 5 is connected to the LED driving and power supply unit 3. The LED driving and power supply unit 3 is connected to the LED light source assembly 4.

The controller 5 is a microcontroller (MCU) or a digital integrated circuit controller. The controller 5 provides a PWM signal for the LED driving and power supply unit 3. The signal of the AC detection unit 2 can be a system interrupt source of the controller 5 to inform the controller 5 the status of the AC input unit 1. At the same time, the LED driving and power supply unit 3 powers the LED light source assembly 4.

The AC detection unit 2 provides switch-status (e.g., on status, off status) of the AC input unit to the controller 5. When the AC input is disconnected, the LED driving and power supply unit 3 provides a delay voltage for the controller 5, such that the controller 5 can detect and store the status of the AC input, forming a certain state machine through the stored status. There is no need to adjust the brightness through continuously turning on or turning off a switch. Because the controller 5 provides such a PWM signal (a frequency is constant by default and a duty cycle is adjustable continuously by default), within a given time period, the brightness can be adjusted from the darkest level to the brightest level by default, or from the brightest level to the darkest level by default; or the brightness can be adjusted from a starting brightness level set by a user to a maximum brightness level set by the user. The duty cycle is the percentage of one period in which a signal is active. The duty cycle can be used to describe the percentage of time of an active signal in an electrical device such as the power switch in a power supply. During the dimming process, the user's desired brightness can be locked by one time turn-off and stored in controller 5. When the switch is turned on again, the brightness is maintained at the level when the switch was turned off last time. In some embodiments, there may be a long time interval between when the switch is turned off to "lock in" the brightness level of the LED lamp and when the switch is turned on again to bring back the same brightness level. In embodiments consistent with the present disclosure, there is no limitation as to how long the time interval is. That is, the controller 5 may store the "locked in" brightness level information for as long as needed. For example, a user may turn off the switch on Day 1 to "lock in" the desired brightness level. When the user turns on the switch next time (e.g., two days later), the light would be turned on at the same brightness level. In other embodiments, a dimmable LED lamp may have a preset maximum time interval for storing data related to the status (e.g., the brightness) of the LED lamp. Before the maximum time interval lapses, if the user turns on the light, the LED lamp may turn on at the "locked in" brightness level. After the maximum time interval lapses, if the user turns on the light, the LED lamp may turn on at a default brightness level. During the dimming process, if the switch is not turned off, the brightness of the dimmable LED lamp is maintained at the level when the dimming process is completed. After that, when the switch is turned off, the brightness adjustment process is reset again.

Figure 3:
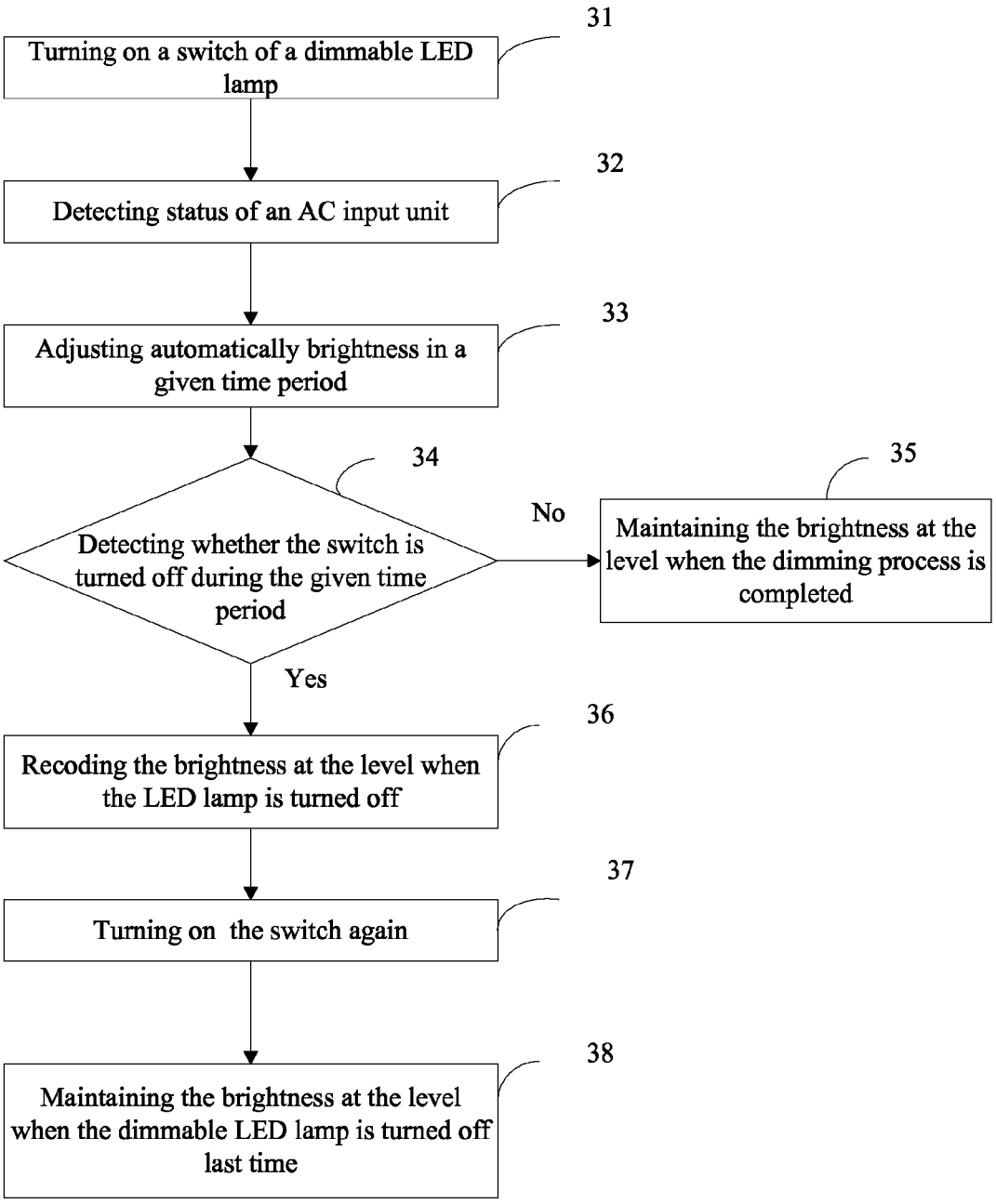
FIG. 3 illustrates a flow chart of an exemplary process for dimming a dimmable LED lamp consistent with the disclosed embodiments.

FIG. 3 illustrates a flow chart of an exemplary process for dimming a dimmable LED lamp consistent with the disclosed embodiments. As shown in FIG. 3, the dimming process may include the following steps.

Step 31: a switch of a dimmable LED lamp is turned on.

Step 32: an AC detection unit detects whether an AC input is power on or power off.

Specifically, the AC detection unit detects switch-status of the dimmable LED lamp. When the AC input is disconnected, an LED driving and power supply unit provides a delay voltage for a controller, such that the controller can store the switch-status every time the switch is turned on or turned off, and a brightness status setting value for each corresponding switch-status.

Step 33: the brightness is adjusted automatically within a given time period.

Specifically, when the switch is turned on, the dimmable LED lamp adjusts the brightness from a set minimum brightness level a set maximum brightness level. When the brightness reaches the maximum brightness level, the dimmable LED lamp maintains the maximum brightness level. In some embodiments, the dimmable LED lamp adjusts the brightness from the set maximum brightness level to the set minimum brightness level. When the brightness reaches the minimum brightness level, the dimmable LED lamp maintains the minimum brightness level. In some embodiments, the dimmable LED lamp adjusts the brightness from one set brightness level to another set brightness level within the given time period.

Step 34: detect whether the switch is turned off within the given time period.

Step 35: if the switch is not turned off within the given time period, the dimmable LED lamp maintains the brightness at the level when the dimming process is completed.

Step 36: if the switch is turned off within the given time period, the controller records the brightness at the level when the dimmable LED lamp is turned off.

Step 37: the switch is turned on again.

Step 38: the brightness of the dimmable LED lamp is maintained at the level when the LED lamp is turned off last time.

Note that, the term "comprising", "including" or any other variants thereof are intended to cover a non-exclusive inclusion, such that the process, method, article, or apparatus containing a number of elements also include not only those elements, but also other elements that are not expressly listed; or further include inherent elements of the process, method, article or apparatus. Without further restrictions, the statement "includes a . . . " does not exclude other elements included in the process, method, article, or apparatus having those elements.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

A dimmable LED lamp is provided. The lamp can include an AC input unit, at least one AC detection unit, at least one LED driving and power supply unit, at least one LED light source assembly, and at least one controller with a pulse width modulation (PWM) output function. The AC input unit is connected to the AC detection unit. The AC detection unit is connected to the controller. The controller is connected to the LED driving and power supply unit. The LED driving and power supply unit is connected to the LED light source assembly. The dimmable LED lamp may integrate all components into one integral piece.

The dimmable LED lamp can implement a step-less dimming process from the darkest level to the brightest level, and can also implement a dimming process between a brightness level set by a user and another brightness level set by the user. The above light adjusting purposes can be achieved through the actions of a switch.

The dimmable LED lamp may be used to replace other conventional lamps or LED lamps without a dimming function by an easy installation. The disclosed dimmable LED lamp can realize the dimming function without much additional changes. Embodiments consistent with the present disclosure thus may decrease the cost of the LED lighting devices.

In some embodiments consistent with the present disclosure, an alternating current (AC) input unit, an AC detection unit, an LED driving and power supply unit, an LED light source assembly, and a controller with a pulse width modulation (PWM) output function may be fully integrated into an LED lighting device. The alternating current (AC) input unit, the AC detection unit, the LED driving and power supply unit, the LED light source assembly, and the controller may be therefore shaped to fit the body of the LED lighting device.

In some embodiments consistent with the present disclosure, an alternating current (AC) input unit, an AC detection unit, an LED driving and power supply unit, and a controller with a pulse width modulation (PWM) output function may be assembled into a control sub-unit that couples with the sub-unit with the LED light source assembly. For example, a sub-unit with the light source assembly may be plugged into the control sub-unit to achieve the desired dimming effect. The control sub-unit may be configured to work with a number of LED light source assemblies. The control sub-unit may have a commonly used connector/socket that can be used to connect to a lighting sub-unit with one or more LED light assemblies.

REFERENCE SIGN LIST

AC input unit 1
AC detection unit 2
LED driving and power supply unit 3
LED light source assembly 4
Controller 5

What is claimed is:

1. A dimmable light emitting diode (LED) lamp, comprising:
an alternating current (AC) input unit;
at least one AC detection unit connected to the AC input unit;
at least one LED driving and power supply unit;
at least one LED light source assembly, wherein the LED driving and power supply unit is connected to the LED light source assembly; and
at least one controller with a pulse width modulation (PWM) output signal,
wherein:
the AC detection unit is connected to the controller;
the controller is connected to the LED driving and power supply unit;
the AC detection unit is configured to detect a switch-status of a switch and an AC input power-off status;
the controller is configured to store the switch-status every time the switch is turned on or turned off, and a brightness level status setting value for each corresponding switch-status;
when the switch is turned on, the dimmable LED lamp automatically and continuously increases or decreases a brightness level within a given time period;
if the switch stays on during the given time period, after the given time period has passed, the dimmable LED lamp maintains the brightness level reached at an end of the given time period; and
if the switch is turned off during the given time period, the controller records the brightness level of the dimmable LED lamp, and when the switch is turned on again afterwards, the brightness of the dimmable LED lamp is maintained at the level when the switch was turned off last time.

2. The lamp according to claim 1, wherein:
when the switch is turned on, the dimmable LED lamp adjusts the brightness from a set minimum brightness level to a set maximum brightness level within a given time period; and
when the brightness reaches the maximum brightness level, the dimmable LED lamp maintains the maximum brightness level.

3. The lamp according to claim 1, wherein:
when the switch is turned on, the dimmable LED lamp adjusts the brightness from the set maximum brightness level to the set minimum brightness level within the given time period; and
when the brightness reaches the minimum brightness level, the dimmable LED lamp maintains the minimum brightness level.

4. The lamp according to claim 1, wherein:
when the switch is turned on, the dimmable LED lamp adjusts the brightness from one set brightness level to another set brightness level within the given time period.

5. The lamp according to claim 1, wherein:
the controller is one of a microcontroller and a digital integrated circuit controller.

6. The lamp according to claim 5, wherein:
the pulse width modulation (PWM) signal outputted by the controller is set to one of the following conditions:
a frequency is constant and a duty cycle is adjustable; and
the frequency is adjustable and the duty cycle is constant.

7. The lamp according to claim 1, wherein:
if the switch stays on during the given time period and is turned off after the given time period, a brightness level adjustment process is reset such that when the switch is turned on next time, the dimmable LED lamp automatically and continuously increases or decreases the brightness level within the given time period.

8. The lamp according to claim 1, wherein:
the switch status refers to a switch being turned on or turned off only; and
the dimmable LED lamp is adjusted to a desired brightness level within three switch operations, including:
turning the switch on,
within the given time period, waiting for a moment when the dimmable LED lamp automatically and continuously adjusts to the desired brightness level and turning the switch off at the moment, and
turning the switch back on such that the dimmable LED lamp maintains at the desired brightness level.

9. A method for dimming a dimmable LED lamp, comprising:
turning on a switch of the dimmable LED lamp;
detecting a status of an AC input, wherein the status of the AC input includes a power-on status and a power-off status;
increasing or decreasing automatically and continuously a brightness level within a given time period;
detecting whether the switch is turned off within the given time period;
when the switch is not turned off within the given time period, maintaining the brightness at the level when a dimming process is completed;
when the switch is turned off within the given time period, recording the brightness level when the dimmable LED lamp is turned off;
turning on the switch again; and
maintaining the brightness at the level when the dimmable LED lamp is turned off last time.

10. The method according to claim 9, wherein:
an AC detection unit detects switch-status of the dimmable LED lamp; and
when the AC input is disconnected, an LED driving and power supply unit provides a delay voltage for a controller, such that the controller stores the switch-status every time the switch is turned on or turned off, and a brightness status setting value for each corresponding switch-status.

11. The method according to claim 9, wherein adjusting automatically brightness within a given time period includes:

when the switch is turned on, adjusting the brightness from a set minimum brightness level to a set maximum brightness level within the given time period; and when the brightness reaches the maximum brightness level, maintaining the maximum brightness level.

12. The method according to claim 9, wherein adjusting automatically brightness within a given time period further includes:

when the switch is turned on, adjusting the brightness from the set maximum brightness level to the set minimum brightness level within the given time period; and when the brightness reaches the minimum brightness level, maintaining the minimum brightness level.

13. The method according to claim 9, wherein adjusting automatically brightness within a given time period further includes:

when the switch is turned on, adjusting the brightness from one set brightness level to another set brightness level within the given time period.

14. A dimmable light emitting diode (LED) lamp, comprising:

an alternating current (AC) input unit;

one AC detection unit connected to the AC input unit;

one LED driving and power supply unit;

one LED light source assembly, wherein the LED driving and power supply unit is connected to the LED light source assembly; and one controller with a pulse width modulation (PWM) output signal, wherein:

the AC detection unit is connected to the controller;

the controller is connected to the LED driving and power supply unit;

the AC detection unit is configured to detect a switch-status of a switch and an AC input power-off status; and the controller is configured to store the switch-status every time the switch is turned on or turned off, and a brightness status setting value for each corresponding switch-status;

when the switch is turned on, the dimmable LED lamp automatically and continuously increases or decreases a brightness level within a given time period;

if the switch stays on during the given time period, after the given time period has passed, the dimmable LED lamp maintains the brightness level reached at an end of the given time period; and if the switch is turned off during the given time period, the controller records the brightness level of the dimmable LED lamp, and when the switch is turned on again afterwards, the brightness of the dimmable LED lamp is maintained at the level when the switch was turned off last time.

15. The lamp according to claim 14, wherein the interval of time is not a preset value.

16. The lamp according to claim 14, wherein the interval of time is a preset value.

* * * * *